US011745520B2

(12) United States Patent
Noh

(10) Patent No.: US 11,745,520 B2
(45) **Date of Patent: *Sep. 5, 2023**

(54) RACK APPARATUS FOR PORTABLE THERMAL SUBLIMATION PRINTER

(71) Applicant: PRINICS CO., LTD., Suwon-Si (KR)

(72) Inventor: Kwang-Ho Noh, Suwon-Si (KR)

(73) Assignee: PRINICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/492,508

(22) Filed: Oct. 1, 2021

(65) Prior Publication Data

US 2022/0016912 A1 Jan. 20, 2022

Related U.S. Application Data

(63) Continuation of application No. 16/172,516, filed on Oct. 26, 2018, now Pat. No. 11,167,571.

(51) Int. Cl.

| | |
|---|---|
| ***B41J 11/14*** | (2006.01) |
| ***B41J 33/14*** | (2006.01) |
| ***B41J 2/32*** | (2006.01) |

(52) U.S. Cl.

CPC ..... *B41J 11/14* (2013.01); *B41J 2/32* (2013.01); *B41J 33/14* (2013.01)

(58) Field of Classification Search

CPC ..... B41J 11/14; B41J 2/32; B41J 33/14

See application file for complete search history.

(56) References Cited

U.S. PATENT DOCUMENTS

| | | | | |
|---|---|---|---|---|
| 5,954,327 | A * | 9/1999 | Lin | B65H 1/12 271/118 |
| 2007/0057995 | A1* | 3/2007 | Kim | B41J 2/17553 347/42 |
| 2011/0024978 | A1* | 2/2011 | Nishikata | B65H 1/12 271/264 |

FOREIGN PATENT DOCUMENTS

| | | |
|---|---|---|
| KR | 10-0226018 B1 | 7/1999 |
| KR | 10-1486327 B1 | 1/2015 |
| KR | 10-1507064 B1 | 3/2015 |

* cited by examiner

*Primary Examiner* — David H Banh

(74) *Attorney, Agent, or Firm* — Goldilocks Zone IP Law

(57) ABSTRACT

The present invention relates to a portable sublimation printer capable of simultaneously controlling up/down of a platen roller of a portable thermal sublimation printer and up/down of a printing medium pickup roller with a rack and pinion mechanism. A portable sublimation printer having a small thickness and a light weight to a rack apparatus of a portable sublimation printer is provided.

10 Claims, 18 Drawing Sheets

RACK APPARATUS FOR PORTABLE THERMAL SUBLIMATION PRINTER

CROSS-REFERENCE TO RELATED APPLICATIONS

The present application is a continuation application of co-pending U.S. patent application Ser. No. 16/172,516, filed on Oct. 26, 2018 and titled, "Rack Apparatus for portable thermal sublimation printer", the disclosure of which is incorporated herein by reference in its entirety.

TECHNICAL FIELD

The present invention relates to a portable thermal sublimation printer capable of simultaneously controlling an up/down of a platen roller for the portable thermal sublimation printer and an up/down operation control of a printing medium pickup roller with a rack and pinion mechanism. Thus, an aspect of the present invention is related to a rack and pinion apparatus of a portable sublimation printer having a small thickness and a light weight.

TECHNICAL BACKGROUND OF THE INVENTION

Recently, according to the rapid spread of smart phones, many people take pictures of events or everyday life.

However, most printers are in the office or at home and most printers are black and white printers.

Even if the user has a color printer, the user cannot print high-quality photos. In order to print photos taken with a smartphone, the user have no choice but to print photos through professional printers.

For this reason, portable thermal sublimation printers capable of printing pictures photographed with a smart phone on the spot with high quality are gradually being developed and distributed.

The thermal sublimation printer is configured to print sequentially three colors of yellow (Y), magenta (M), and cyan (C) on the printing medium with the thermal print head high quality.

At this time, the up/down operation of the printing medium pickup roller for moving the printing medium and the operation for up/down controlling the printing roller for bringing the printing medium into close contact with the heat-sensitive thermal print head must be coordinated with each other at a correct timing.

For this reason, in the conventional portable thermal sublimation printer, the up/down operation of the pickup roller and the up/down operation of the platen roller are operated in cooperation with a cam, when the cam device is used, since a DC motor is used, a separate reflector is required, so that the apparatus is complicated, the thickness of the printer becomes thick, and the weight becomes heavy.

Further, a device for winding the ribbon in conjunction with the operation of transferring the printing medium to the thermal print head for printing, a separate lever is required to transmit/cut the power to the device that winds the ribbon, and when the lever is stiff, the down operation of a platen is unclear or the power switching is not smooth.

RELATED ARTS

Patent Document 1: Patent Registration No. 10-1486327, titled "Cam for portable thermal sublimation printer," issued on Jan. 20, 2015;

Patent Document 2: Korean Patent Registration No. 10-1507064, titled "take-up reel operator for thermal sublimation printer" issued on Mar. 24, 2015; and Patent Document 3: Korean Patent Registration No. 10-0226018, titled "Printer," issued on Jul. 23, 1999.

SUMMARY OF THE INVENTION

It is an object of the present invention to provide a rack and pinion mechanism capable of precisely controlling the up and down driving of the platen roller and the pickup roller by sliding the rack using the rack and pinion mechanism, It is an object of the present invention to provide a rack apparatus for a portable sublimation printer which can rotationally drive a pickup roller without a separate motor and which performs power switching of the swing gear at the same time by sliding the rack.

It is also an object of the present invention to provide a rack apparatus of a portable sublimation printer which is simple structure, thin in thickness and light in weight.

In order to achieve the above object, an aspect of the present invention provides a rack 106 having a rack gear 107 engaged with a pinion 102 slides in a printer;

an inclined wedge 115 is fastened to one side of the rack 106 and lifts the platen roller 133 when the rack 106 slides; and a swing lever 117 may transmit or cut the power to the take-up unit driving unit 127 by rotating the swing gear 120 when the rack 106 slides.

In addition, when the rack 106 slides, a pickup roller driving unit lifts or lowers the pickup roller 105 located above the cartridge housing 134 in which the printing medium is loaded.

Thus, the lifting and lowering of the platen roller 133, the rotation of the swing lever 117, and the lifting and lowering of the pickup roller 105 are co-operated each other.

The printer may further include the platen roller lifting regulator may regulate the lifting/lowering of the platen roller 133 when the rack 106 slides according to an aspect of the present invention.

The pickup roller driving unit may include a pickup roller guide groove 108, The pickup roller driving unit includes a pickup roller guide groove 108 formed by a horizontal portion 109 and an inclined portion 110 in which the horizontal portion 109 extends in an inclined manner on the side of the rack 106.

The bracket shaft **104*a* is hinged to the printer frame, and the bracket shaft 104*a* and the pickup roller shaft 105*a* hinged to the pickup roller bracket 104 are spaced apart a predetermined distance, and a pickup roller bracket arm 128 protruded from the bracket shaft 104*a*** in an orthogonal direction.

A protrusion 129 protruded from the pickup roller bracket arm 128 and inserted into the pickup roller guide groove 108.

The pickup roller 105 rotates around the bracket shaft **104*a* and ups/downs when the protrusion 129 of the pickup roller bracket arm 128 passes the inclined portion 110**.

In addition, the pickup roller gear 103 is coupled to the pickup roller shaft **105*a* and the pickup roller gear 103 is engaged with the pinion 102 to rotate the pickup roller 105 in conjunction with the rotation of the pinion 102** according to an aspect of the present invention.

The swing lever 117 may include a rod-shaped swing lever body 118, a capstan roller shaft fixing hole 119 formed at one side of the swing lever body 118 to receive a shaft of the capstan roller 132, A swing gear 120 hinged at a predetermined distance from the capstan roller shaft fixing hole 119 and a swing lever fixing protrusion 121 protruded from the other side of the swing lever body 118 are formed.

The swing lever fixing protrusion 121 is configured to abut the swing gear guide side 112 formed on the lower side of the rack rod 111 extended to a predetermined height from the rack 106.

The swing gear 120 is engaged with or separated from the take-up gear 126 when the swing lever fixing protrusion 121 pass through the inclined portion 114 of the swing gear guide side 112.

The swing gear 120 is configured to engage with the gear engaged with the shaft of the capstan roller 132 and to rotate in conjunction with the capstan roller 132.

The capstan roller 132 and the take-up gear 126 rotate in conjunction with the capstan roller 132 when the capstan roller 132 rotates.

In addition, the platen roller lifting regulating portion has a platen roller shaft fixing hole 124 in which a shaft of the platen roller 133 is inserted.

A capstan roller shaft fixing hole 119 is formed one side of the platen roller shaft fixing hole 124 in which the capstan roller 132 is inserted.

A platen arm 122 is formed on the other side of the platen roller shaft fixing hole 124.

The platen arm fixing protrusion 125 is protruded from platen arm in the lateral direction and is configured to abut the swing gear guide side 112 formed on the lower side of the rack rod 111 extended to a predetermined height from the rack 106.

As the platen arm fastening protrusion 125 comes into contact with the lower side of the rack 106 after passing over the inclined portion 114 of the swing gear guide side 112 when the rack 106 slides so that a lift regulation of the platen roller 133 can be released.

The wedge 115 is formed on one side of the rack 106 with inclined shape so that when the wedge 115 is inserted or pulled out below the platen bracket 136 to move up/down the platen roller 133 when the rack 106 slides.

Effects of the Invention

The rack and pinion apparatus of the portable sublimation printer of the present invention configured as described above can precisely control the up/down driving of the platen roller and the pickup roller by sliding the rack.

By sliding the rack, the swing gear can be driven to rotate and the power of the swing gear can be switched at the same time by the sliding movement of the rack. Therefore, the portable sublimation printer having a simple structure can be constructed.

DETAILED DESCRIPTION OF THE INVENTION

Figure 1:
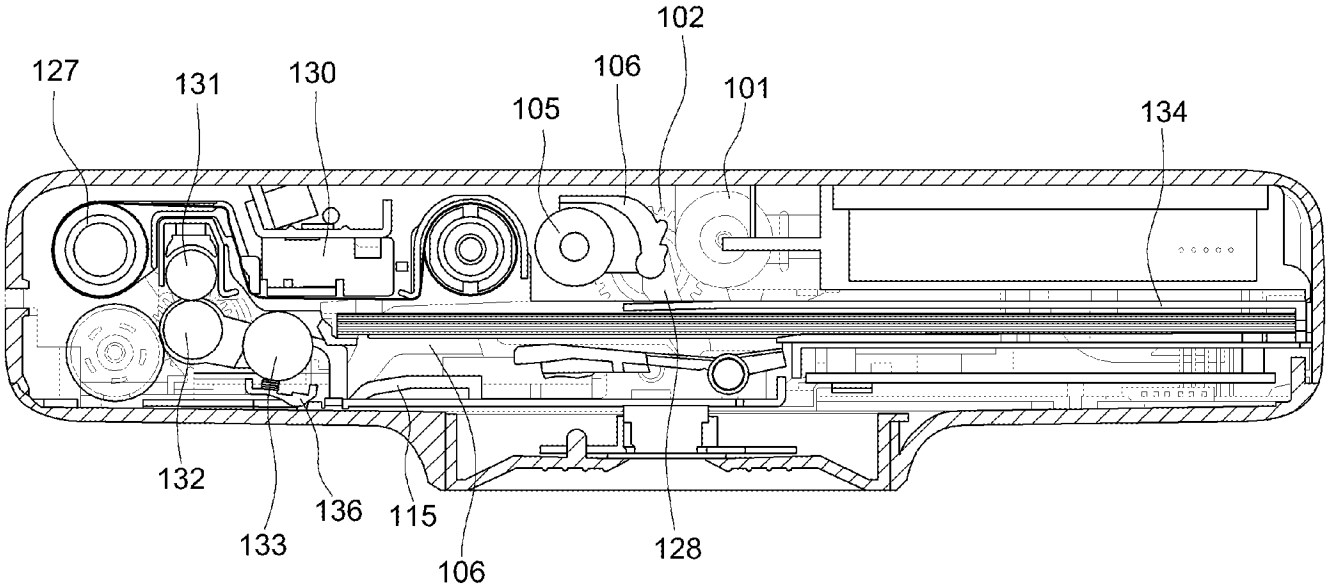
FIG. 1 is a sectional view showing an internal structure of a portable sublimation printer according to the present invention.

Hereinafter, the present invention will be described in detail with reference to preferred embodiments of the present invention and the accompanying drawings, wherein like reference numerals refer to like elements.

FIGS. 1 through 21, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device. The following description with reference to the accompanying drawings is provided to assist in a comprehensive understanding of exemplary embodiments of the disclosure as defined by the claims and their equivalents. It includes various specific details to assist in that understanding but these are to be regarded as merely exemplary. Accordingly, those of ordinary skilled in the art will recognize that various changes and modifications of the embodiments described herein can be made without departing from the scope and spirit of the disclosure. In addition, descriptions of well-known functions and constructions may be omitted for clarity and conciseness.

As shown in FIG. 1, a portable sublimation printer generally includes a cartridge housing 134 in which a printing medium is loaded in a printer, and a pickup roller 105 is lowered into a cartridge housing 134 for picking up from the uppermost printing medium among the loaded printing medium so that the printing medium passes over the thermal print head 130.

The drawn printing medium passes over the thermal print head 130 by driving the pinch roller 131 and the capstan roller 132 of the printer and then enters the lower portion of the thermal print head 130 again so that the thermal print head 130 prints a specific color on the printing medium by heating.

At this time, the platen roller rises to closely contact the printing medium with the thermal print head 130.

When the specific color is printed, the platen roller 133 lowers and the printing medium is moved by driving the pinch roller 131 and the capstan roller 132 to pass the thermal print head 130, and the capstan roller 132 to move the printing medium to the thermal print head 130 to print another color.

At this time, the platen roller 133 rises to closely contact the printing medium with the thermal print head 130.

This process is repeated to print cyan (C), magenta (M), and yellow (Y) to print the photograph on the printing medium.

In this printing process, the platen roller 133 rises to closely contact the printing medium to the thermal print head 130 during the printing process, and during the simple movement of the printing medium other than the printing process, the platen roller 133 is lowered.

In the printing process, the take-up unit driving unit 127 of the printer continuously rotates the ribbon to feed the new ribbon, thereby maintaining the print quality.

The rack apparatus of the sublimation printer according to an aspect of the present invention may drive and control the pickup roller 105, the platen roller 133 and the take-up unit driving unit 127 of the printer in cooperation with each other through a rack and a pinion mechanism.

Figure 2:
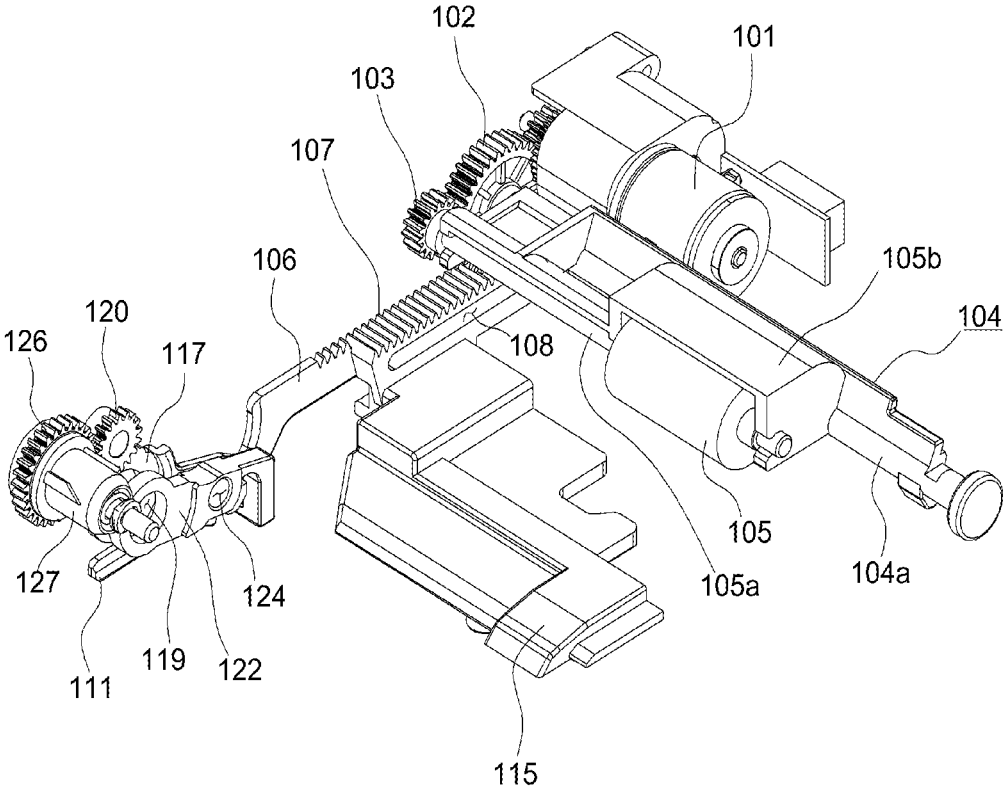
FIG. 2 is a front perspective view showing a main part of a portable sublimation printer rack apparatus according to the present invention.
Figure 3:
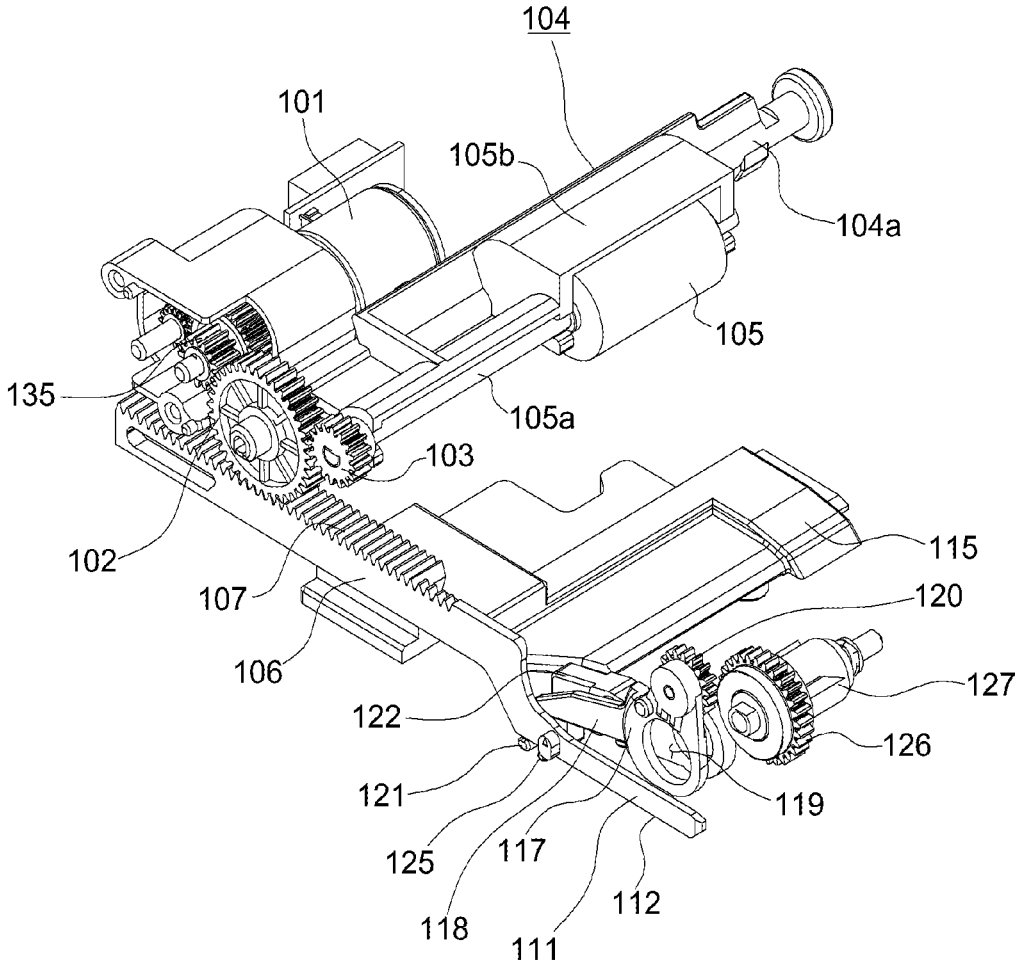
FIG. 3 is a rear perspective view showing a main part of a portable sublimation printer rack apparatus according to the present invention

FIGS. 2 and 3, the pinion 102 is connected to the shaft of the mode motor 101, and the pinion 102 is engaged with the rack gear 107 formed on the upper side of the rod-shaped rack 106.

At this time, it is preferable that the rotation shaft of a mode motor 101 and the pinion 102 are connected through a reduction gear 135.

The rack 106 is provided with a pickup roller driving unit for up/down of the pickup roller 105. The driving unit of the pickup roller 105 according to an aspect of the present invention is as follows.

Figure 4:
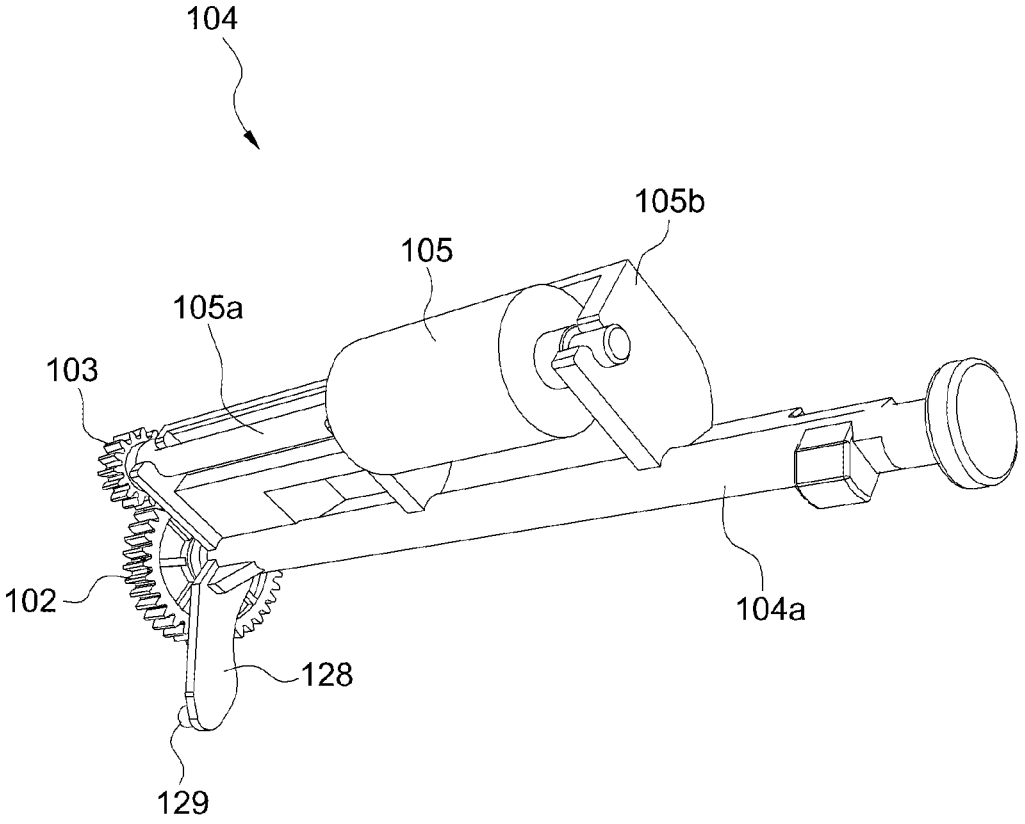
FIG. 4 is a perspective view showing a pickup roller bracket of a rack device according to an aspect of the present invention.

The pinion 102 is fastened to one side of the bracket shaft 104*a* hinged to the printer body (not shown) and fastened to the bracket shaft 104*a* so as to freely rotate as shown in FIG. 4.

As shown in FIG. 4, the pickup roller bracket 104 may include a bracket shaft 104*a* having both ends hinged to a printer body (not shown), a pickup roller shaft 105*a* spaced apart from the bracket shaft 104*a* by a predetermined distance, and a pickup roller 105 fixed to the pickup roller shaft 105*a*.

It is preferable that the pickup roller 105 is enclosed and protected by a pickup roller cover 105*b* formed on the bracket shaft 104*a*.

One end of the pickup roller shaft 105*a* is fixed to the pickup roller gear 103 and the pickup roller gear 103 is engaged with the pinion 102.

As shown in FIG. 4, a pickup roller bracket arm 128 having a predetermined length in a perpendicular direction to the axis 104*a* protruded from the bracket shaft 104*a* and the pickup roller bracket arm 128 provided with a protrusion 129 on one side thereof respectively.

As shown in FIG. 3, the pinion 102 is engaged with a rack gear 107 formed on the upper side of the rack 106.

The rack 106 has a rack gear 107 on the upper side of the rack 106 as shown in FIGS. 5-8.

Figure 8:
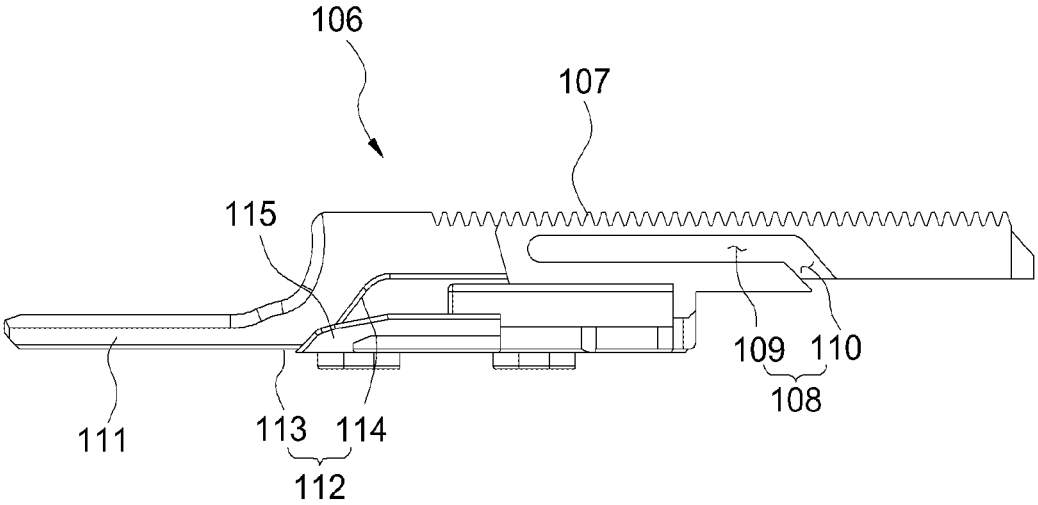
FIG. 8 is a rear view showing a rack constituting the rack apparatus according to an aspect of the present invention.

As shown in FIG. 8, a rack rod 111 is formed at the end of the rack 106 in the form of a rack 106 extending from the rack 106 downward by a height (not shown).

A swing gear guide side 112 is formed on the lower side of the rack rod.

The swing gear guide side 112 is composed of an inclined portion 114 inclined at a predetermined angle with a horizontal plane 113.

A pickup roller guide groove 108 is formed on one side of the rack 106 such that the flat horizontal section 109 and the horizontal section 109 are inclined downward and an inclined portion 110 formed in an elongated shape.

The protrusion 129 of the pickup roller bracket arm 128 of the pickup roller bracket 104 is inserted into the groove-shaped pickup roller guide groove 108 formed on one side of the rack 106 described above.

Figure 5:
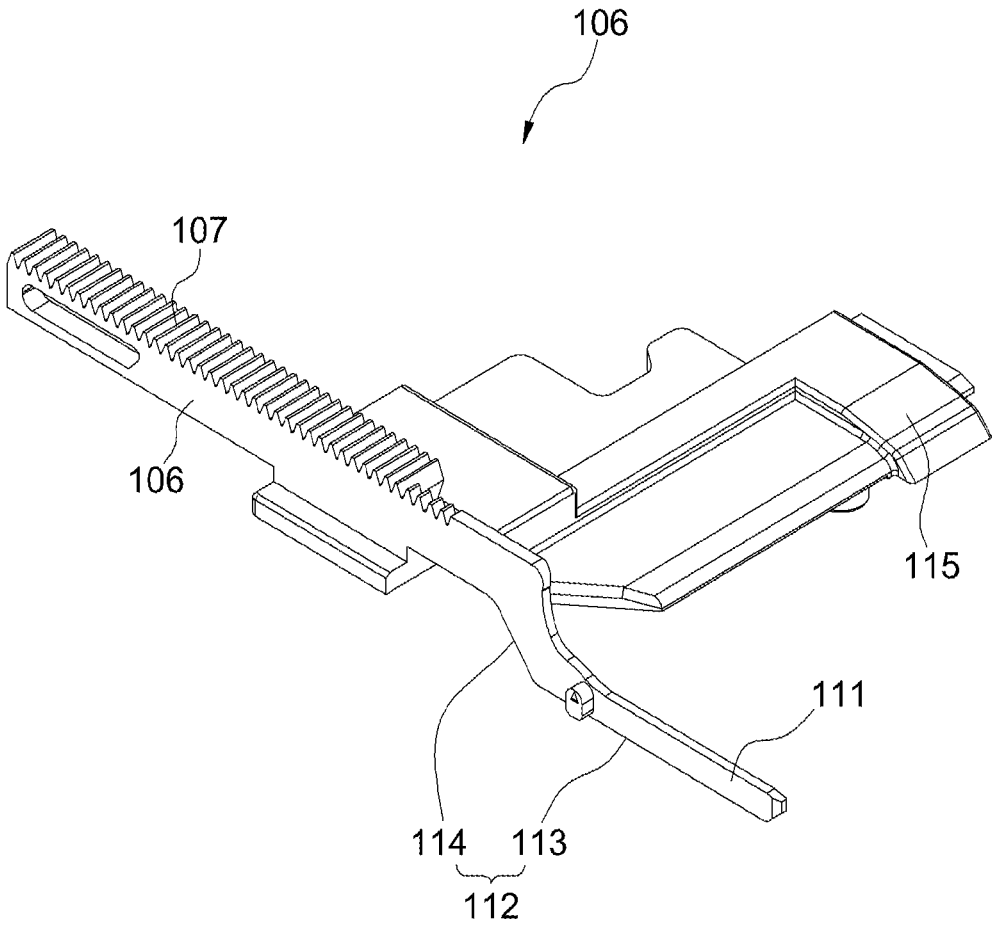
FIG. 5 is a front perspective view showing a rack of the rack apparatus according to an aspect of the present invention.
Figure 6:
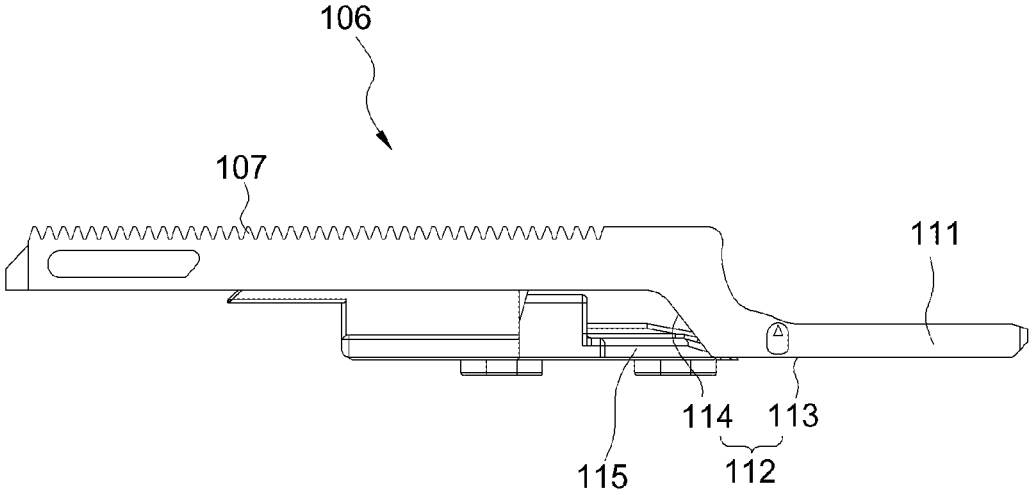
FIG. 6 is a front view showing a rack of the rack apparatus according to an aspect of the present invention.
Figure 7:
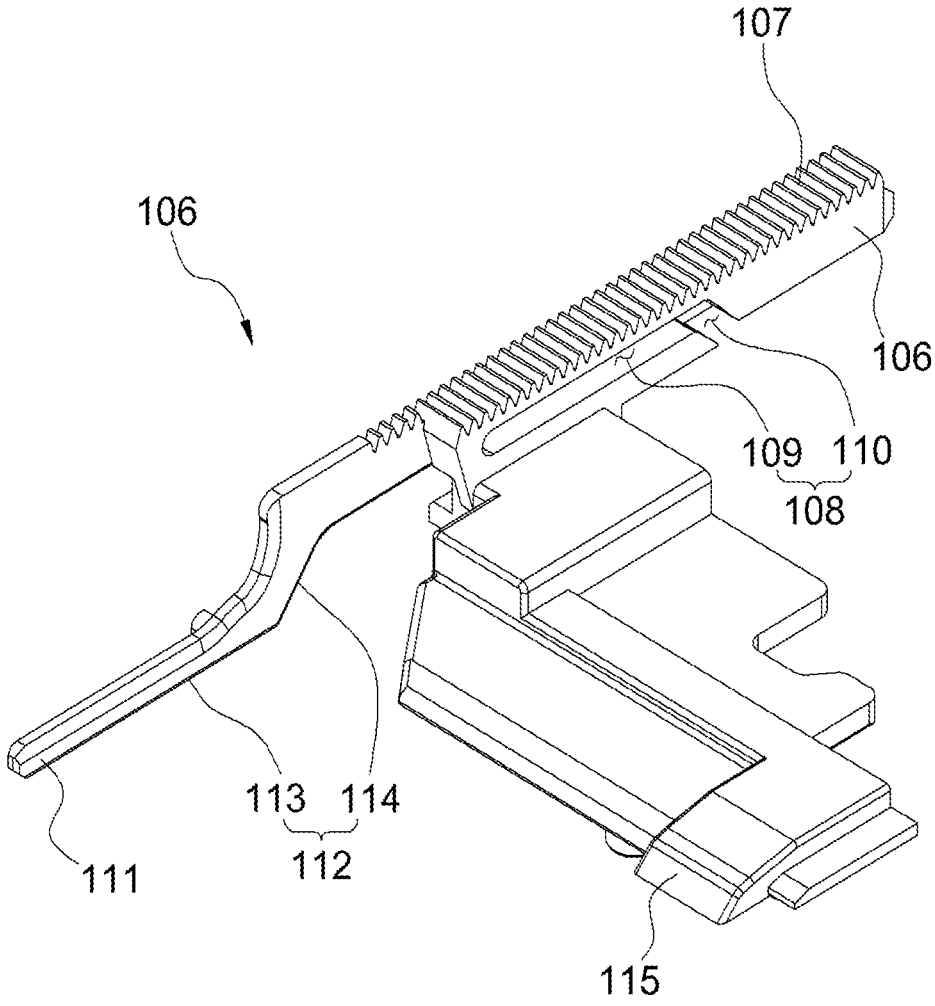
FIG. 7 is a rear perspective view showing a rack of the rack apparatus according to an aspect of the present invention.

As shown in FIGS. 2, 5, to 8, a wedge 115, which is in a inclined shape, is integrally formed with the rack 106 on one side of the rack 106.

When the rack 106 is slid by the rotation of the pinion 102, the protrusion 129 formed on the pickup roller bracket arm 128 of the pickup roller bracket 104 is engaged with the pickup roller guide groove and the pickup roller 105 moves up and down by rotating the bracket shaft 104*a* along the pickup roller guide groove 108.

The swing lever 117 and the platen arm 122 of FIGS. 2 and 3 are controlled by the rack rod 111 with the end of the rack 106 extended.

Figure 9:
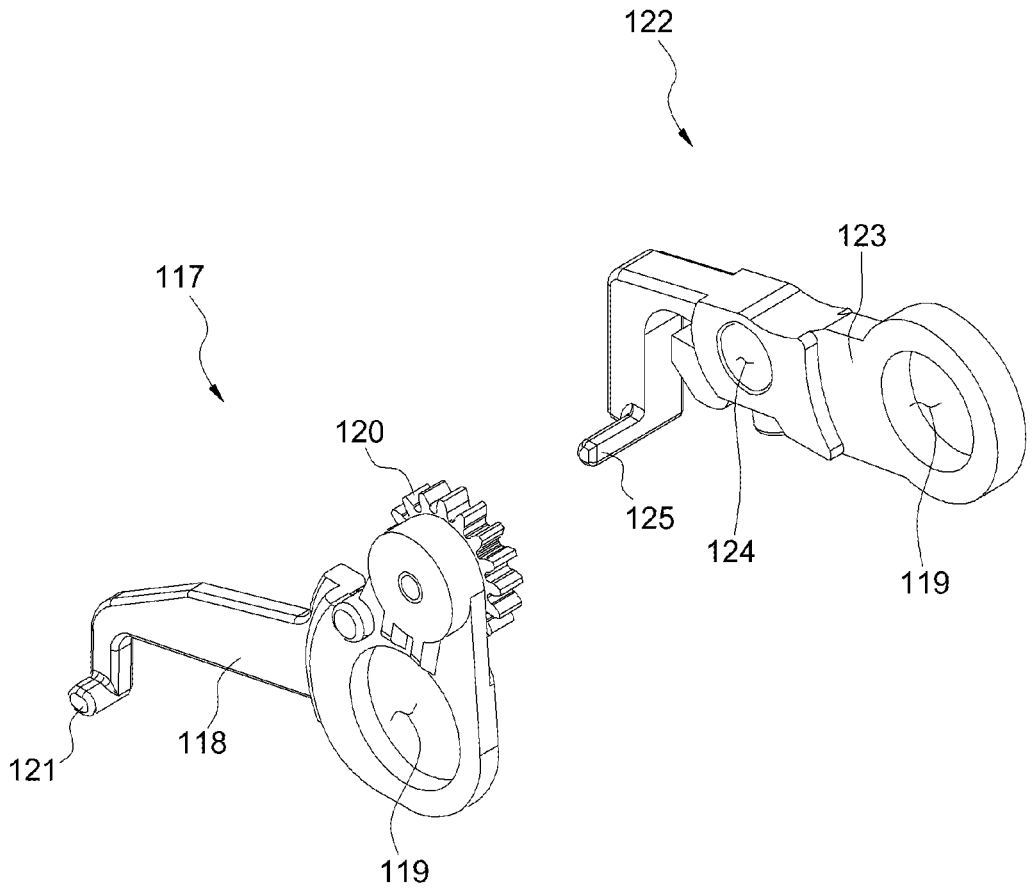
FIG. 9 is a perspective view showing a swing lever and a platen arm the rack apparatus according to an aspect of the present invention.

Referring to FIG. 9, the swing lever 117 has a swing lever body 118 formed in a rod shape, a capstan roller shaft fixing hole 119 formed in a hole on one side of the swing lever body 118. The swing lever fixing protrusion 121 protrudes laterally from the other side of the swing lever body 118.

A swing gear 120, which rotates in conjunction with the capstan roller 132, is hinged to an upper portion of the capstan roller shaft fixing hole 119.

A platen arm 122 may include a platen arm body 123 in a form of rod, the capstan roller shaft fixing hole 119 is formed at one side of the platen arm body 123 in a form of a hole, a planet roller arm fixing protrusion 125 protruded from at the another side of the platen arm body, a platen roller capstan shaft fixing hole 124 is formed in the center of the platen arm body 123.

The capstan roller shaft is inserted into the capstan roller shaft fixing hole 119 of the swing lever 117 and the platen arm 122.

when the shaft of the capstan roller 132 is inserted into the capstan roller shaft fixing hole 119 of the swing lever 117 and the platen arm 122 as shown in FIG. 1, the swing lever fixing protrusion 121 and the platen arm fixing protrusion 125 of the platen arm 122 are brought into contact with the swing gear guide side 112 which is the lower side of the rack rod 111 of the rack 106 as shown in FIG. 3.

The swing gear 120 is located at one side of the take-up gear 126 of the take-up unit driving unit 127 that take-ups the ribbon in the printer.

The operation(s) of the rack apparatus of the portable thermal sublimation printer according to an aspect of the present invention as described above will be described.

Figure 10:
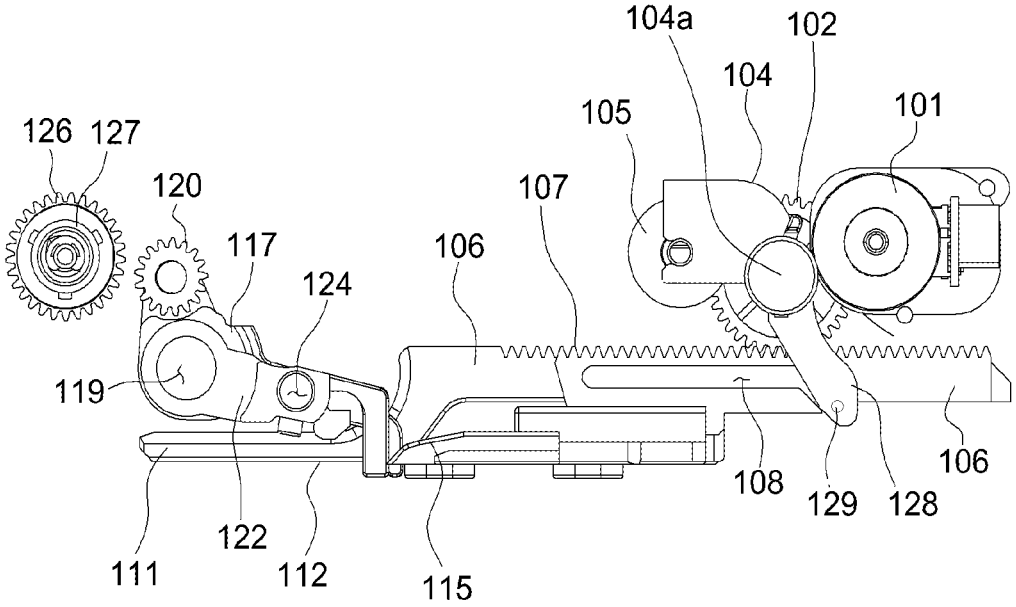
FIG. 10 is a front view showing a rack apparatus in a neutral state according to an aspect of the present invention.
Figure 13:
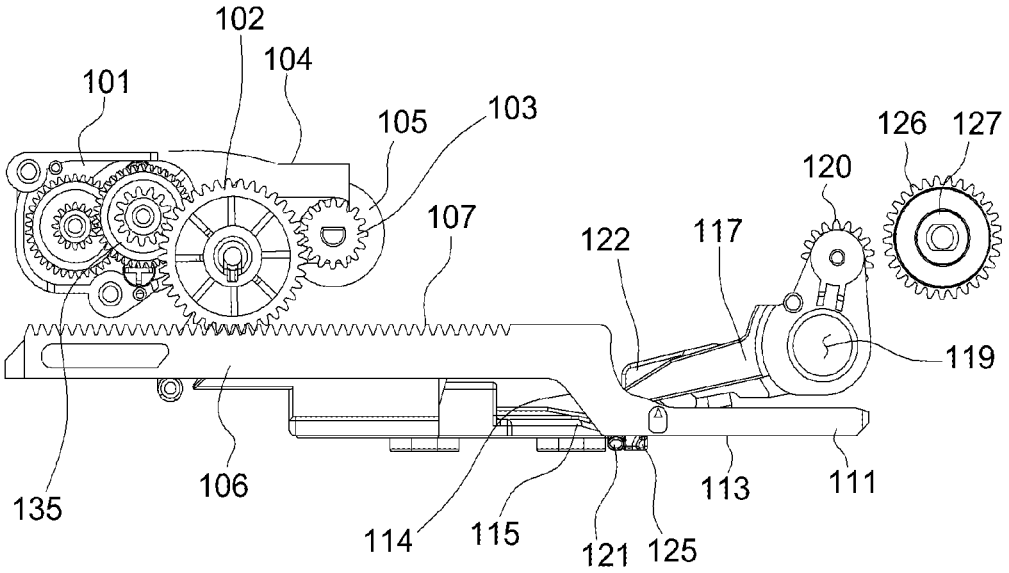
FIG. 13 is a rear view showing a rack apparatus in a neutral state according to an aspect of the present invention.
Figure 16:
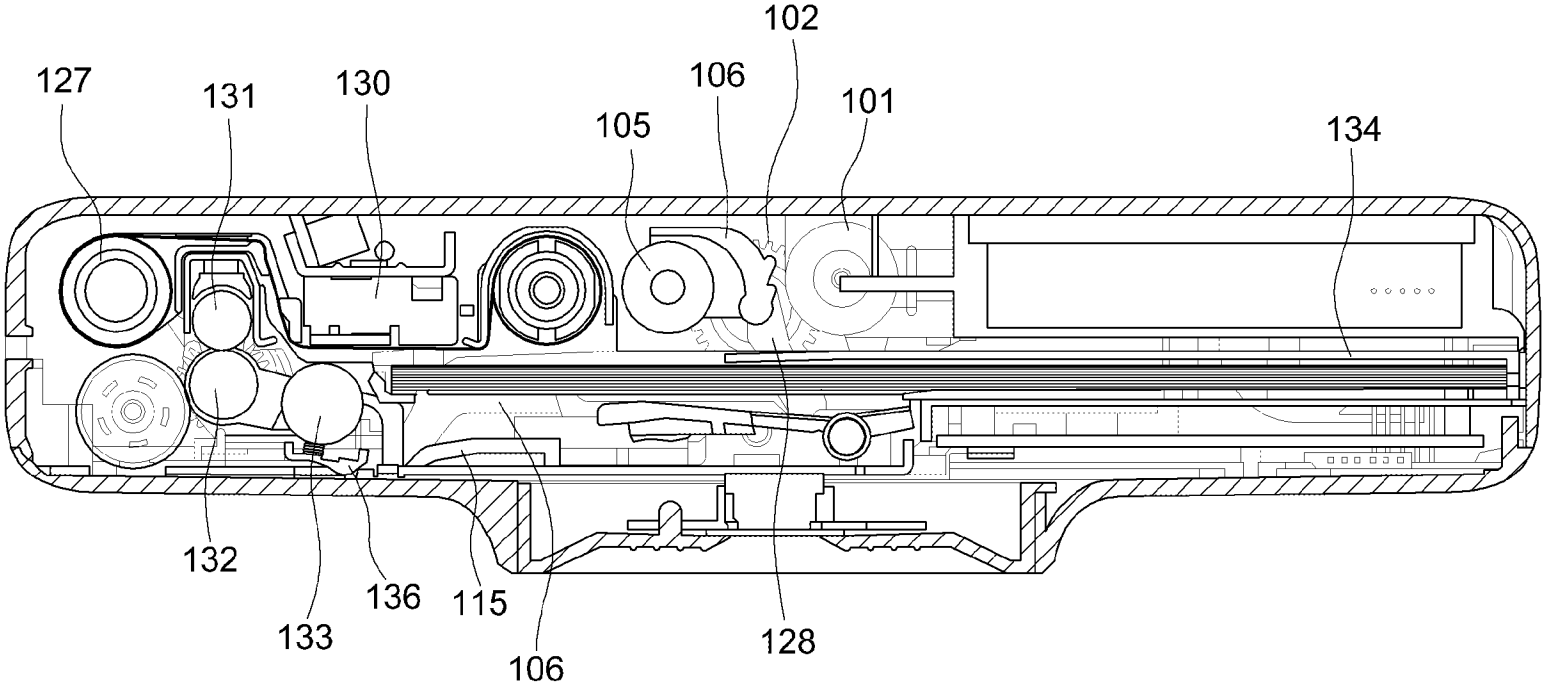
FIGS. 16 to 21 are diagrams showing operation steps of the portable sublimation printer according to an aspect of the present invention.

FIGS. 10, 13, and 16 are views showing the state of the rack apparatus in a neutral state in which the printer is not operated in the printing operation according to an aspect of the present invention.

In a neutral state, the protrusion 129 formed on the pickup roller bracket arm 128 of the pickup roller bracket 104 is positioned below the inclined portion 110 of the pickup roller guide groove 108, and the pickup roller 105 is in a lifted state.

The swing lever fixing protrusion 121 of the swing lever 117 and the platen arm fixing protrusion 125 of the platen arm 122 are engaged with each other in the direction of the inclined portion 114 of the swing gear guide side 112 and the swing gear 120 of the swing lever 117 is spaced apart from the take-up gear 126 by a predetermined distance.

Also, the platen roller 133 is in a full-down position, the pickup roller 105 is in a full-up position, and the printing medium is loaded in the cartridge housing 134.

Figure 17:
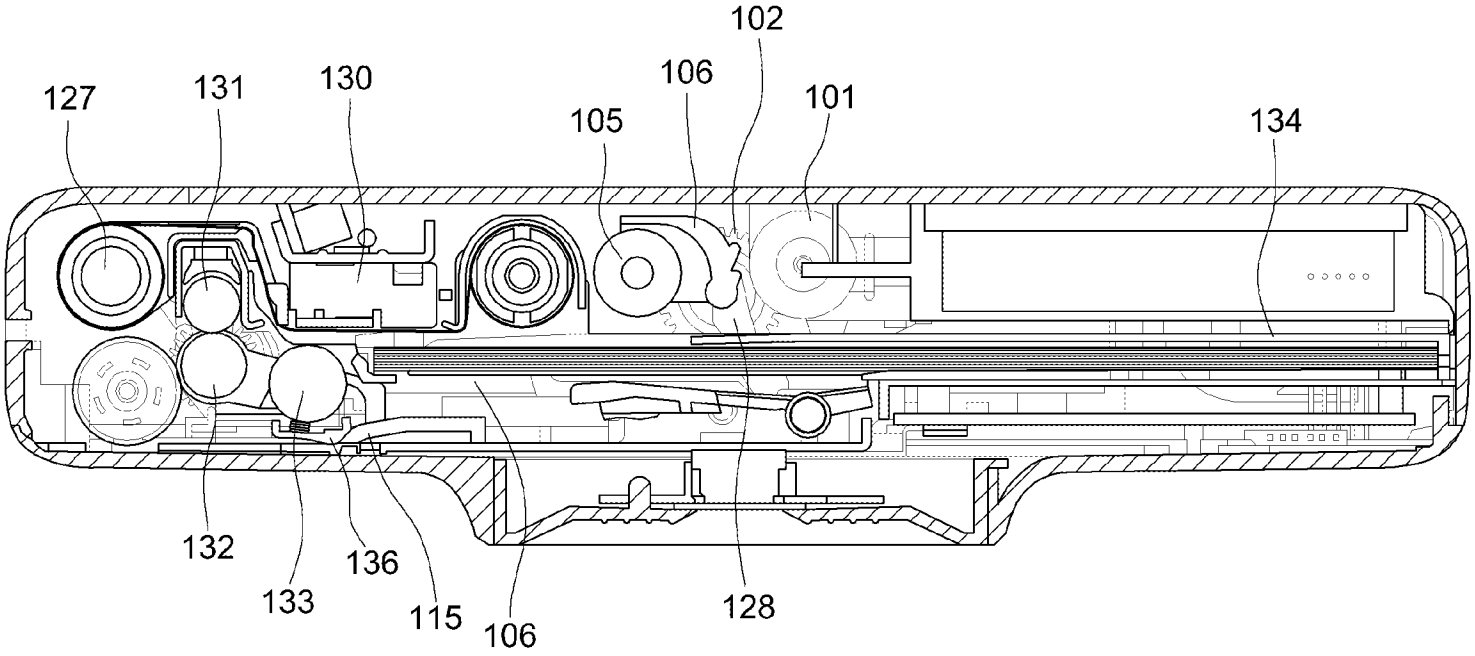

When the printer starts printing in this state, the rack 106 moves slightly to the left, in a direction of the thermal print head 130, as shown in FIG. 17, The wedge 115 formed on one side of the rack lifts the platen bracket 136 slightly up so that the platen roller 133 is lifted in a half-up position.

The swing lever fixing protrusion 121 of the swing lever 117 moves from the horizontal plane 113 of the rack 106 to the inclined portion 114 while the rack 106 moves slightly to the left so that the swing gear 120 is engaged with a gear of the take-up unit driving unit 127 to rotate the take-up unit driving unit 127 in a counterclockwise direction and supplies a new ribbon to the thermal print head 130.

At this time, since the protrusion 129 of the pickup roller bracket arm 128 is still positioned in the inclined portion 110 of the pickup roller guide groove 108, the pickup roller 105 is kept in the up state without being lowered.

Figure 14:
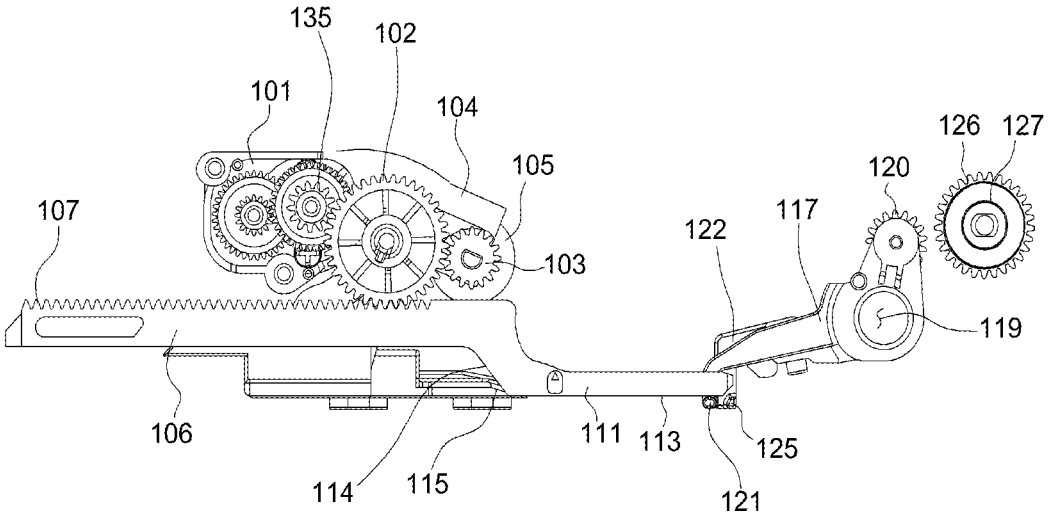
FIG. 14 is a rear view showing the rack device in a state in which the rack is slid rearward according to an aspect of the present invention.
Figure 18:
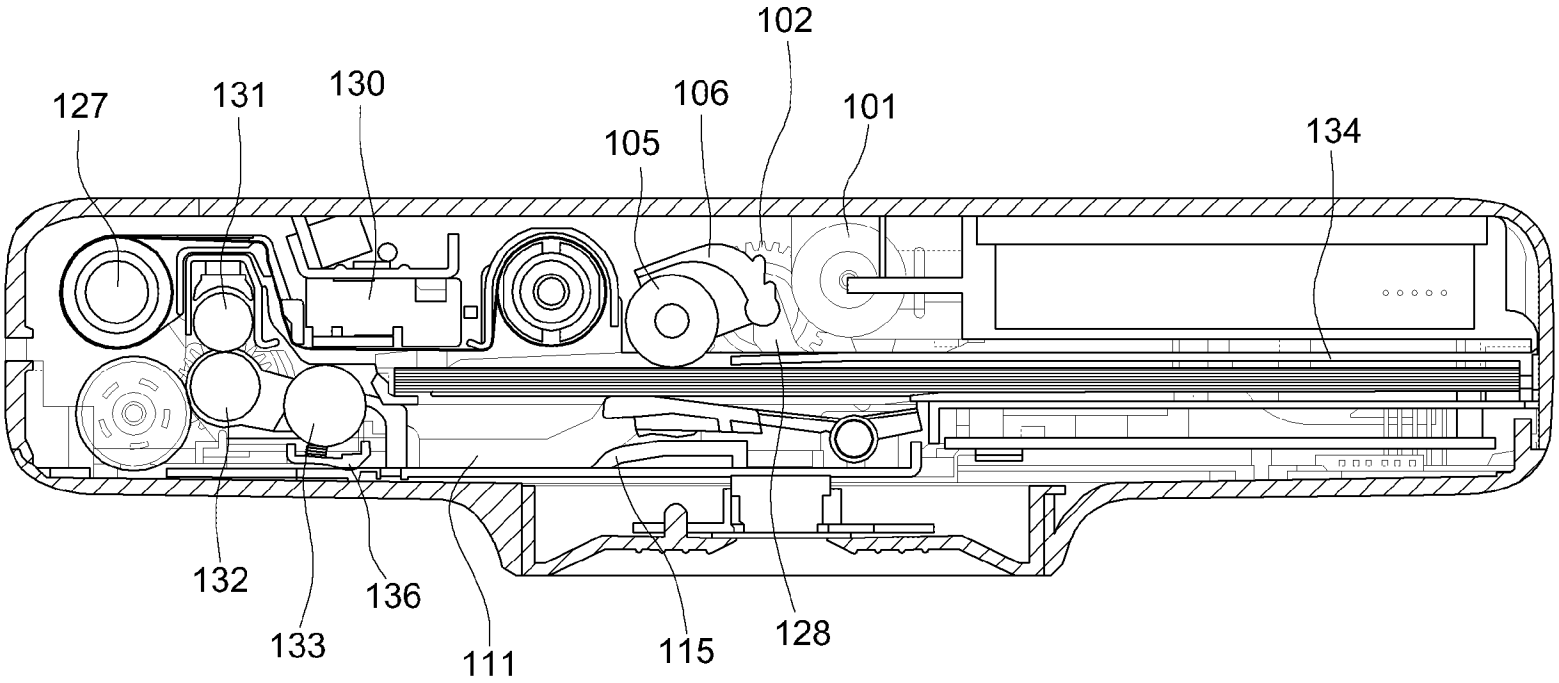

As shown in FIGS. 1, 14, and 18, when the new ribbon is supplied to the thermal print head 130, the mode motor 101 is driven to rotate the pinion 102 to move the rack 106 to the right, the opposite direction of the thermal print head 130.

Figure 11:
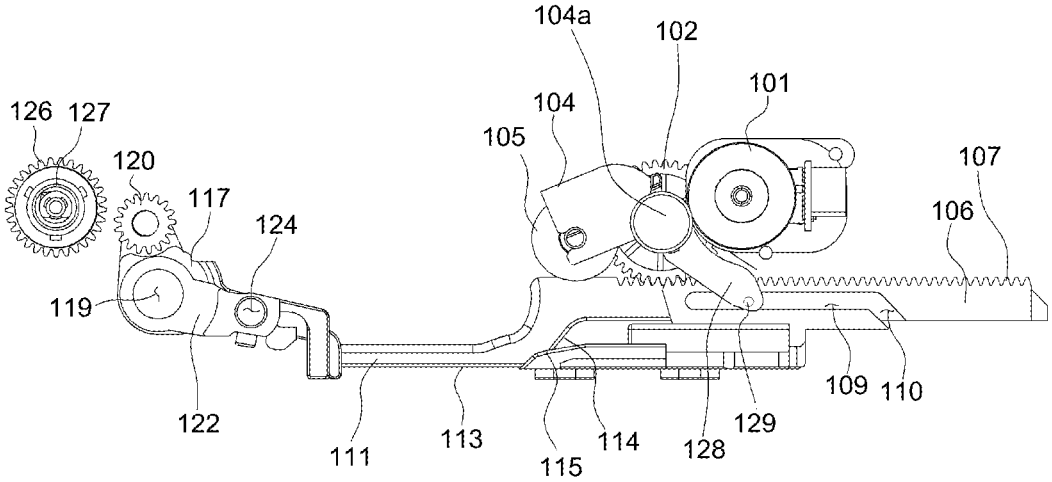
FIG. 11 is a front view showing the rack device in a state in which the rack is slid rearward according to an aspect of the present invention.

As shown in FIGS. 11 and 14, when the rack 106 moves rearwardly, the protrusion 129 of the pickup roller bracket arm 128 moves up along the inclined portion 110 of the pickup roller guide groove 108 of the rack 106 and entered into the horizontal portion 109. As a result, the pickup roller 105 rotates about the bracket shaft 104*a* and lowers as the pickup roller bracket arm 128 rotates about the bracket shaft 104*a*.

As shown in FIG. 3, the pickup roller gear 103 of the pickup roller shaft 105*a* is engaged with the pinion 102, so that the pickup roller 105 lowers and rotates for picking up the loaded printing medium in the cartridge housing 134.

At this time, the pickup roller 105 is rotated about the pickup roller shaft 105*a* while the pinion 102 rotates and the rack 106 slides.

The swing lever fixing protrusion 121 of the swing lever 117 and the platen arm fixing protrusion 125 of the platen arm 122 keep in contacting with the horizontal plane of the swing gear guide side 112 which is the lower side of the rack rod 111 of the rack 106.

The swing gear 120 is positioned (unmated) on one side of the gear of the take-up unit driving unit 127 that take ups the ribbon in the printer.

When the printing process of the printer is started, the pickup roller 105 lowers and contacts the printing medium positioned at the uppermost position of the cartridge housing 134, takes out the printing medium and moves until the printing medium passes the thermal print head while the platen roller 133 maintains pull-down position as shown in FIG. 18.

As shown in FIG. 18, the pickup roller 105 is lowered to draw the printing medium out of the cartridge housing 134 to allow the printing medium to pass the thermal print head 130. After the printing medium is conveyed to the thermal print head 130 and then printing is performed as shown in FIG. 19.

Figure 12:
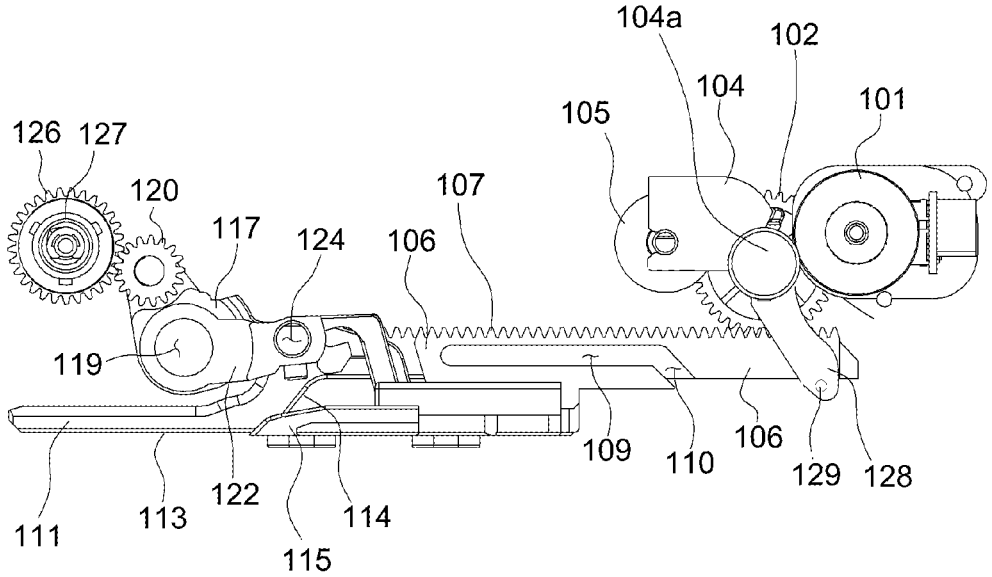
FIG. 12 is a front view showing the rack apparatus in a state in which the rack is slid forward according to an aspect of the present invention.
Figure 15:
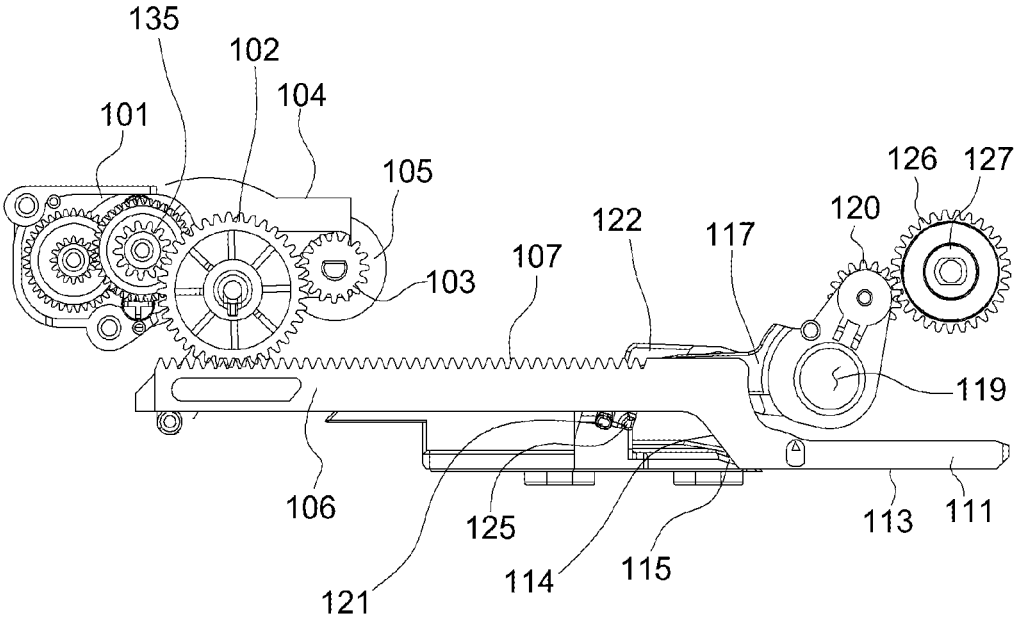
FIG. 15 is a rear view showing a rack apparatus in which the rack is slid forward according to an aspect of the present invention.
Figure 19:
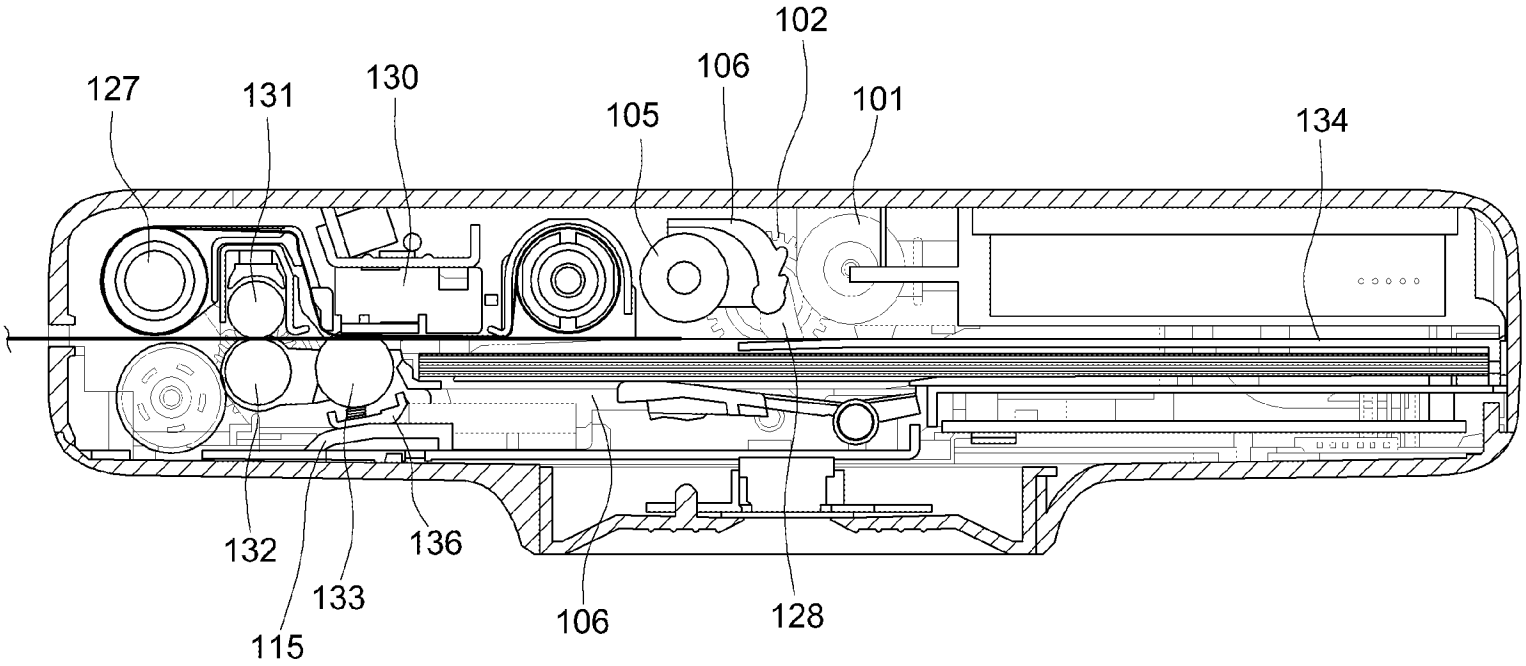

After the printing medium passes through the thermal print head 130, the mode motor 101 is driven to rotate in a reverse direction to reverse the rotation of the pinion 102, to the direction of the thermal print head 130 as shown in FIGS. 12, 15, and 19.

When the rack 106 is moved to the left as shown in FIGS. 12, 15, and 19, the protrusion 129 of the pickup roller bracket arm 128 is moved down along with the inclined portion 110 of the pickup roller guide grooves 108 and pickup roller bracket arm 128 rotates around bracket shaft 104*a*, and the pickup roller 105 rotates around the bracket shaft 104*a* in conjunction with the rotation of the pickup roller bracket arm 128 about the bracket shaft 104*a* so that the pickup roller 105 is separated from the printing medium.

The swing lever fixing protrusion 121 of the swing lever 117 and the platen arm fixing protrusion 125 of the platen arm 122 move in a direction of along a lower side of the rack rod 106, the inclined portion 114 of the swing gear guide side 112, and the horizontal plane 113 side of the swing gear guide side 112 which is a lower side of the rack rod 111 of the rack 106.

Since the shaft of the capstan roller 132 of the printer is inserted into the capstan roller shaft fixing hole 119 of the swing lever 117 and the platen arm 122 as shown in FIGS. 16 to 21, The swing lever fixing protrusion 121 of the swing lever 117 and the plate arm fixing protrusion 125 of the platen arm 122 are moved along the inclined portion 114 of the swing gear guide surface 112, which is the lower side of the rack rod 111 of the rack 106.

As shown in FIG. 11, the swing lever 117 and the platen arm 122 rotate about the shaft of the capstan roller 132, which is a counterclockwise direction from the capstan roller shaft fixing hole 119, when the swing lever 117 and the platen arm 122 move down the rack 106 along the horizontal plane 113.

When the swing lever 117 rotates as described above, the swing gear 120 of the swing lever 117 is engaged with the take-up gear 126 to rotate the take-up unit driving unit 127 for supplying the ribbon to the thermal print head 130 as shown in FIG. 12.

The swing gear 120 is engaged with the gear (not shown) of the rotating capstan roller in the printing process, so that the power of the capstan roller 132 is supplied to or blocked from the take-up unit driving unit 127.

As shown in FIGS. 12, 15, and 19, the wedge 115 formed on one side of the rack 106 is inserted into the lower portion of the platen bracket 136 to move the platen roller 133 up to the pull-up position when rack 106 moves to the left.

Thus, the platen roller 133 may closely contact the printing medium with the thermal print head 130 so that the printing operation is smoothly completed.

Figure 20:
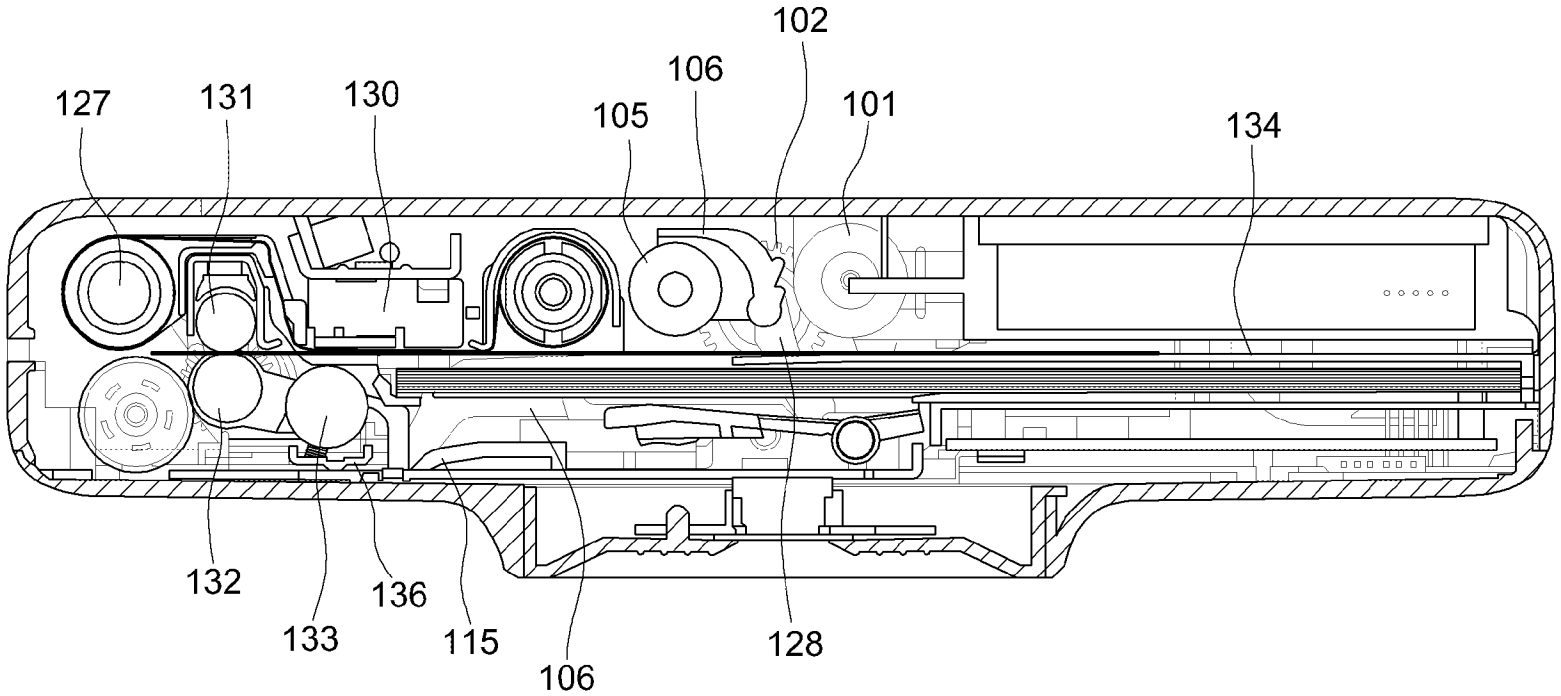

Then, as shown in FIG. 20, the rack moves to the right to move the wedge 115 to lower the platen roller to the pull-down position, and to rotate the pinch roller 131 and the capstan roller 132 for moving one color printed printing medium to the left to pass the thermal print head 130.

The thermal sublimation printer performs cyan (C), magenta (M), and a yellow (Y) color successively printing. One color is printed through the above process, and the remained colors are printed by repeating the above process.

Figure 21:
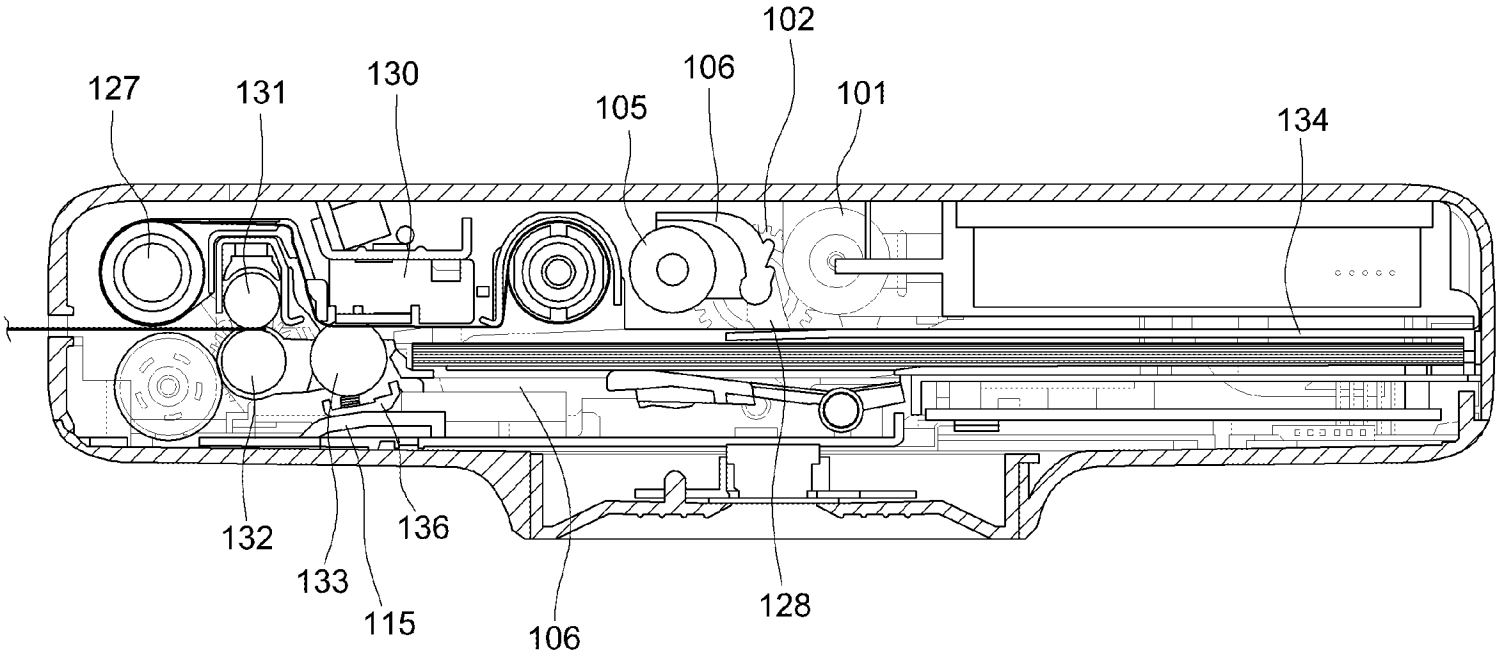

After all three colors have been printed, the printing process is completed by discharging the printing medium from the thermal sublimation printer as shown in FIG. 21, thereby discharging the printing medium 130 while coating the surface of the printing medium, it returns to the neutral state as shown in FIG. 16.

The printer may include a regulator for restraining the platen roller 133 from lifting in a neutral state.

The platen arm fixing protrusion 125 of the platen arm 122 is coupled to the horizontal plane 113 of the rack rod 111 in a neutral state. Thus, the platen arm 122 is refrained from lifting as shown in FIG. 10.

However, the platen arm 122 can be released to rotate as the platen arm 122 moves away from the swing gear guide surface 112 and then the platen roller 133 can be lifted shown in FIG. 14.

As described above, aspects of the present invention can accurately control the up/down driving of the platen roller 133 and the pickup roller 105 by using the rack 106 and the pinion 102, The pickup roller 105 can be driven to rotate without a separate motor by the slide movement and the power switching of the swing gear 120 is simultaneously performed by the slide movement of the rack 106.

The technical idea of the present invention has been described above with reference to the embodiments.

It will be apparent to those skilled in the art that various modifications and variations can be made in the present invention without departing from the spirit or scope of the invention.

Also, although not explicitly shown or described, those skilled in the art will be able to make various modifications including the technical idea of the present invention from the description of the present invention Which is still within the scope of the present invention.

DESCRIPTION OF REFERENCE NUMERALS

101: Mode motor
102: pinion
103: pickup roller gear
104: pickup roller bracket
104*a*: bracket shaft
105: pickup roller
105*a*: pickup roller shaft
105*b*: pickup roller cover
106: Rack
107: Rack gear
108: Pickup roller guide groove
109: horizontal portion
110: inclined portion
111: rack rod
112: swing gear guide side
113: horizontal plane
114: slop or inclined portion
115: Wedge
117: swing lever
118: swing lever Body
119: capstan roller shaft fixing hole
120: swing gear
121: swing lever fixing protrusion
122: platen arm
123: platen arm body
124: platen roller shaft fixing hole
125: platen arm fixing protrusion
126: take-up gear
127: take-up unit driving unit
128: Pickup roller bracket arm
129: protrusion
130: thermal print head
131: pinch roller
132: capstan roller
133: platen roller
134: cartridge housing
135: reduction gear
136: platen bracket

What is claimed is:

1. A thermal sublimation printer having a rack apparatus, comprising:
- a cartridge housing;
- a platen roller for pressing a printing medium;
- a pickup roller;
- a take-up unit driving unit for taking-up a ribbon;
- a rack having a rack gear configured to slide in the thermal sublimation printer;
- an inclined shape wedge attached at one side of the rack configured to lift the platen roller when the rack slides;
- a swing gear accommodated at a one side of a take-up gear;
- a swing lever which rotates the swing gear when the rack slides, and transmits or cuts a power to the take-up unit driving unit; and
- a pickup roller driving unit configured to lift or lower the pickup roller located above the cartridge housing in which the printing medium is loaded when the rack slides, thereby the rotation of the swing lever and the lifting and lowering of the pickup roller are operated in conjunction with the lifting and lowering of the platen roller.

2. The thermal sublimation printer of claim 1, the rack further comprising: a platen roller lifting/lowering regulator that regulates the lifting/lowering of the platen roller when the rack slides.

3. The thermal sublimation printer of claim 1, wherein the pickup roller driving unit including: a pickup roller guide groove having a horizontal portion formed in a side of the rack and an inclined portion where the horizontal portion is extended to in a shape of inclined, a bracket shaft hinged to the printer, a pickup roller shaft spaced apart from the bracket shaft by a predetermined distance and hinged to the pickup roller bracket, a pickup roller bracket arm protruded from the bracket shaft in an orthogonal direction to the bracket shaft, a protrusion protruded from the bracket arm and is inserted into the pickup roller guide groove, thereby the pickup roller rotates about the bracket shaft and lifts/lowers when the protrusion of the pickup roller bracket arm passes through the inclined portion of the pickup roller guide groove.

4. The thermal sublimation printer of claim 3, wherein the pickup roller gear is engaged with the pickup roller shaft and the pickup roller gear is engaged with a pinion so that the pickup roller rotates in conjunction with the rotation of the pinion.

5. The thermal sublimation printer of claim 1, wherein the swing lever includes: a swing lever body in a form of bar; a capstan roller shaft fixing hole formed at one side of the swing lever body to receive a capstan roller shaft; a swing gear hinged to the capstan roller shaft fixing hole with a predetermined distance, the swing lever fixing protrusion protruded from the other side of the swing lever body and formed at a lower side of the rack rod extended from the rack with a predetermined height, and configured to contact the swing gear guide side formed on the lower side of the rack, thereby the swing gear is engaged with or separated from the take-up gear when the swing lever fixing protrusion passes the inclined portion of the swing gear guide part when the rack slides.

6. The thermal sublimation printer of claim 5, wherein the swing gear is configured to engage with the gear engaged with the shaft of the capstan roller and to rotate in conjunction with the capstan roller when the swing gear is engaged with the take-up gear is configured to rotate in conjunction with the capstan roller.

7. The thermal sublimation printer of claim 2, wherein the platen roller lifting/lowering regulator includes: a platen roller shaft fixing hole formed at a center of the platen lifting/lowering regulator in which a capstan roller is inserted is formed at one side of the platen roller shaft fixing hole, the capstan roller shaft fixing hole is formed in another side of the platen roller shaft fixing hole, and a platen arm having a laterally protruding platen arm fixing protrusion is formed at the other side of the platen roller shaft fixing hole, wherein the platen arm fixing protrusion is configured to abut the swing gear guide part formed on the lower side of the rack rod extended to a predetermined height from the rack, thereby lifting regulation of the platen roller released when the platen arm fixing protrusion comes into contact with the lower side of the rack through the inclined portion of the swing gear guide side when the rack is slid.

8. The thermal sublimation printer of claim 1, wherein the wedge is formed on one side of the rack with an inclined portion, and is configured to lift/lower the platen roller while the wedge is inserted into or drawn out below the platen bracket when the rack slides.

9. A thermal sublimation printer having a rack apparatus, comprising:

a platen roller for pressing a printing medium;

a pickup roller;

a take-up unit driving unit for taking-up a ribbon;

a pinion;

a rack having a rack gear configured to slide in the thermal sublimation printer;

an inclined shape wedge attached at one side of the rack configured to lift the platen roller when the rack slides;

a swing gear accommodated at a one side of a take-up gear;

a swing lever configured to transmit or cut a power the swing gear in accordance with a sliding movement of the rack; and a pickup roller driving unit configured to lift or lower the pickup roller located above a cartridge housing in which the printing medium is loaded when the rack slides, thereby the rotation of the swing lever and the lifting and lowering of the pickup roller are operated in conjunction with the lifting and lowering of the platen roller.

10. The thermal sublimation printer of claim 9, wherein the rack is slid by a rotation of the pinion in the thermal sublimation printer.

* * * * *